United States Patent [19]

Attar

[11] Patent Number: 4,465,493

[45] Date of Patent: Aug. 14, 1984

[54] DESULFURIZATION PROCESS FOR COAL AND OTHER CARBONACEOUS MATERIALS

[76] Inventor: Amir Attar, 103 Bervie Ct., Cary, N.C. 27511

[21] Appl. No.: 334,536

[22] Filed: Dec. 28, 1981

[51] Int. Cl.[3] ..... C10L 9/02

[52] U.S. Cl. ..... 44/1 SR; 201/17; 208/238; 423/461

[58] Field of Search ..... 44/1 SR; 201/17; 423/461; 208/237, 238

[56] References Cited

U.S. PATENT DOCUMENTS 2,814,588 11/1957 Hutchings ..... 201/17
3,284,531 11/1966 Shaw et al. ..... 208/237
3,340,184 9/1967 Eng et al. .

OTHER PUBLICATIONS

"Chemical Technology of Petroleum"—William A. Gruse & Donald R. Stevens, McGraw-Hill Bk. Co., 1960 [pp. 304-306].

*Primary Examiner*—Delbert E. Gantz
*Assistant Examiner*—Anthony McFarlane
*Attorney, Agent, or Firm*—Mills & Coats

[57] ABSTRACT

A desulfurization process is described which consists of heating an organic hydrocarbon like coal or bitumen in a stream of a gaseous or liquid trapping material for hydrogen sulfide ($H_2S$). The organic sulfur in the hydrocarbon decomposes and releases $H_2S$ which reacts with the trapping material to form a metastable sulfur compound. The resulting gaseous or liquid stream is recovered and decomposed in a subsequent step to form $H_2S$ and to the original trapping material. The trapping material is recovered and recirculated into the reactor. Ethylene, propylene and other olefins, as well as aldehydes and ketones are found to be excellent trapping materials.

1 Claim, 1 Drawing Figure

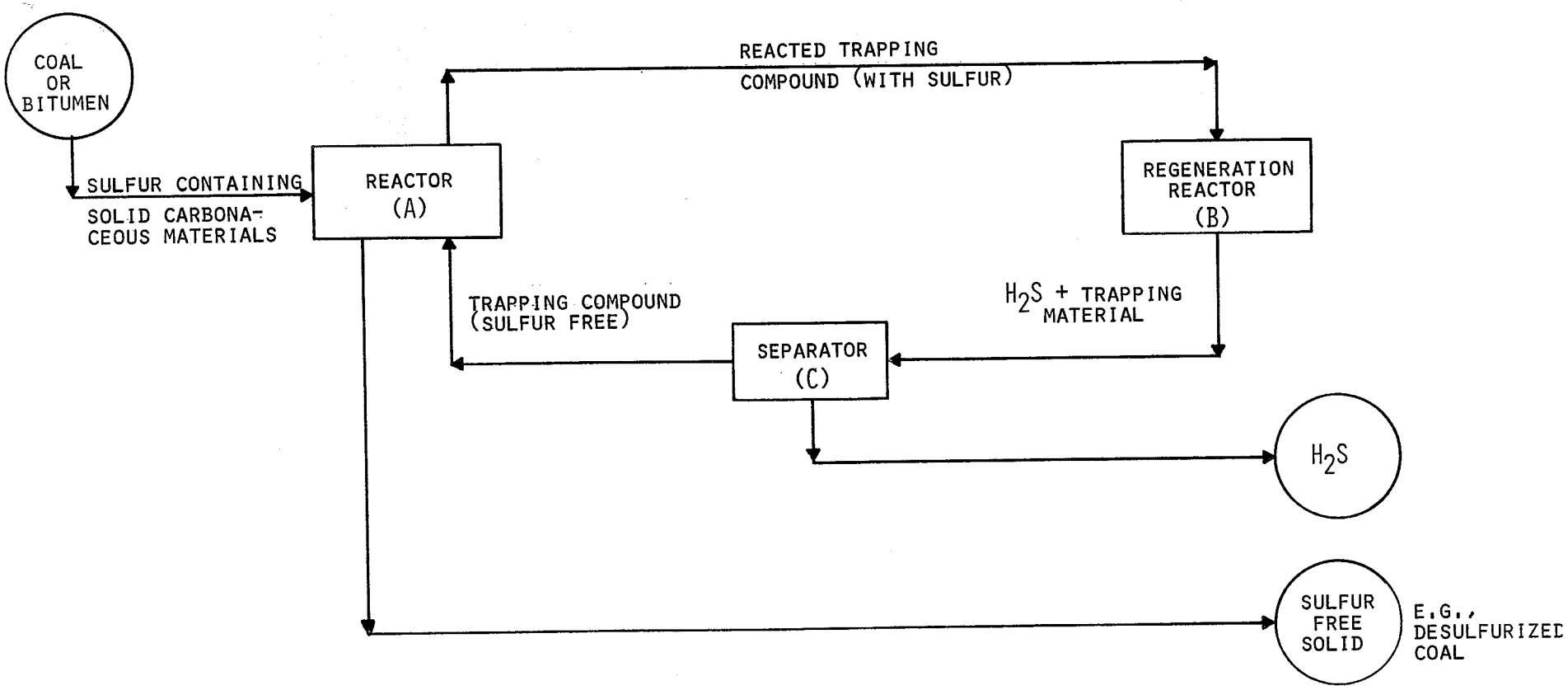
FIGURE 1. SCHEMATIC DIAGRAM OF THE DESULFURIZATION PROCESS

DESULFURIZATION PROCESS FOR COAL AND OTHER CARBONACEOUS MATERIALS

BACKGROUND OF THE INVENTION

The state of the art of desulfurization of carbonaceous materials was reviewed by Attar in the 83rd Annual AICHE Meeting in Chicago, Ill. in November of 1980. (Copies of the paper are in the AICHE microfilm library.) The processes can be divided into the following categories: (1) desulfurization in oxidizing environment, e.g., the Arco, JPL, KVB, Ames and DOE processes, which use air, oxygen, chlorine or nitrogen oxide, to oxidize the coal and the sulfur compounds; (2) desulfurization processes using bases, e.g., the Battelle's Hydrothermal process or TRW's Gravimelt and Gravichem processes which use NaOH or $Ca(OH)_2$ in aqueous solutions; (3) desulfurization using hydropyrolysis, in which the coal is heated and pyrolyzed at a high temperature to produce desulfurizd char and hydrogen sulfide. Examples of such processes are Occidental's steam-hydrogen cyclic desulfurization process, IGT's hydrodesulfurization process and Illinois State Geological Survey's hydropyrolysis process; (4) miscellaneous other processes have been proposed including some which remove only pyritic sulfur, e.g., the Nedlog process which uses a magnetic field to separate iron pyrite, and several biodesulfurization processes. The proposed process is not related to any of the previously mentioned processes.

DESCRIPTION OF THE INVENTION

A two-step desulfurization process is used to remove sulfur from coal, tar sand, bitumen. The two steps consist of:

1. reacting the carbonaceous material with a compound which reacts with hydrogen sulfide ($H_2S$), e.g., ethylene, propylene and other chemically similar compounds, herein referred to as the "trapping material";
2. separating the sulfur containing reaction product and decomposing it to a stream of $H_2S$ and regenerated trapping material.

Contact times needed for reacting the trapping material with the carbonaceous material are generally under 20 minutes at the temperature range of 370°–430° C. for coals or at 180°–390° C. for bitumens. Application of pressures of 50–500 psi during the reaction enhances the sulfur removal rate, increases the desulfurization and allows treatment of larger particles. Reduction in the pressure and increasing the temperature allow catalytic and non-catalytic decomposition of the sulfurized trapping material to (1) $H_2S$ and (2) regenerated trapping material. The solid product of the reaction is coal, and not char. Therefore, it can be used in conventional pulverized fuel burners with no modifications of the burners.

FIG. 1 is a schematic diagram of one possible arrangement of the process units. The three major components are:

A. the desulfurization reactor,
B. the regeneration reactor, and
C. the $H_2S$-separator.

Tables 1 and 2 describe the range of operating variables in the two reactors, assuming that the trapping material is ethylene and/or propylene. Separation of $H_2S$ from ethylene, propylene and from simlar materials is a well-established technology and will therefore not be discussed here.

Reactor B can be a catalytic plug flow or an empty tube reactor, depending on the trapping material used.

TABLE 1

Range of Operation Variables in the Desulfurization Reactor (A)

| Temperature (°C.) | | Pressure (psi) | | Particle Size (mesh) | | Residence Time (min.) | |
|---|---|---|---|---|---|---|---|
| Range | Preferred Range | Range | Preferred Range | Range | Preferred Range | Range | Preferred Range |
| 60–470 | 300–450 coal<br>60–300 bitumen | Vacuum–1000 | 80–200<br>100–600 bitumen | 1" to −325 | ¼" to −60 | 1 sec. to 3 hr. | 3–30 min. |

TABLE 2

Range of Operation Variables in the Regeneration Reactor* (B)

| Temperature (°C.) | | Pressure (psi) | | Residence Time (min.) | |
|---|---|---|---|---|---|
| Range | Preferred Range | Range | Preferred Range | Range | Preferred Range |
| 250–700 | 450–550 | Vacuum–100 | 10–50 | 0.01 sec.–20 min. | 0.1 sec–2 min. |

*Assuming no catalyst is used.

The sulfur compounds in carbonaceous materials decompose upon heating in reducing environment preferentially to hydrogen sulfide ($H_2S$) and unsaturated compounds, e.g.:

$$\text{Coal} \xrightarrow{\Delta} H_2S + \text{carbonaceous materials} \quad (1)$$

The $H_2S$ can react back with the solid matrix (where there is no trapping material) or with a trapping material. In the first case, no net desulfurization of the solid will be observed but in the second case, low sulfur solid will be produced once the sulfurized trapping material and the solid are separated. Typical trapping materials may be ethylene, propylene, other olefins, aldehydes, ketones, in liquid or gaseous form, or their mixtures which react reversibly with $H_2S$. When the trapping material is ethylene, the reaction is:

$$CH_2CH_2 + H_2S \xrightarrow{\text{HIGH P}} CH_3CH_2SH \quad (1)$$

Application of increased pressure in the reactor enhances the rate of trapping, increases the equilibrium concentration of products like $CH_3CH_2SH$, and allows desulfurization of larger coal particles.

Once the resulting sulfurized trapping material is separated from the solid carbonaceous material, its pressure is reduced and its temperature increased. The sulfurized trapping material decomposes to $H_2S$ and to the original trapping material. An example of the reaction where ethylene is the trapping material is:

$$CH_3CH_2SH \xrightarrow[\text{with or without catalyst}]{\Delta} CH_2CH_2 + H_2S \quad (2)$$

Passing the gaseous mixture through a catalyst bed enhances the rate of decomposition of some sulfurized trapping materials.

Separation of the $H_2S$ from the regenerated trapping material can be accomplished by established technologies, e.g., distillation or absorption.

EXAMPLES 1-6

Several tests were conducted with a high sulfur Illinois #6 bituminous coal with and without a wash with dilute HCl. The characteristics of the raw material are described below:

TABLE 3

The Ultimate Analysis and Sulfur Forms of the Coal of the Study

| | Element | C | H | O | S | N | Ash |
|---|---|---|---|---|---|---|---|
| Unwashed | wt. % | 70.44 | 5.08 | 9.96 | 3.52 | 1.30 | 9.7 |
| Washed | wt. % | | | | | | 8.8 |

| | Sulfur Form | Total | Pyritic | Sulfatic |
|---|---|---|---|---|
| Unwashed | wt. % | 3.52 | 0.35 | 0.42 |
| Washed | wt. % | 3.10 | 0.35 | 0.007 |

The residence time of the bituminous coal in the reactor with the gaseous ethylene or $N_2$ according to the examples was 15 min at 410±5° C. at 100 psi. The flow rate of ethylene or $N_2$ was approximately 200 $cm^3$/min and in the reactor there were 6 gms of −250 mesh coal. The sulfur forms in the coal products of the reaction are described in Table 4. The table also shows the total sulfur in the reacted coal after HCl wash. The data demonstrate clearly the effectiveness of $C_2H_4$ as a trapping material for $H_2S$ and its effectiveness as a compound which reduces the recombination reaction of $H_2S$ with the solid matrix.

Mild pyrolysis of the coal appears to remove organic sulfur from coal and to convert some of the pyritic sulfur into iron sulfides. However, in the presence of calcium, i.e., when raw off mine coal is mildly pyrolyzed, no or little loss of sulfur is observed, since the sulfur released appears to react back with the basic minerals in the coal, according to the following reaction:

$$H_2S + CaO \rightarrow CaS + H_2O$$

or:

$$H_2S + CaCO_3 \rightarrow CaS + H_2O + CO_2$$

However, when a gaseous trapping material like $C_2H_4$ is flowed through the reactor, it competes with the calcium minerals and sweeps the sulfur away from the reactor. Thus, a net desulfurization is observed. Since removal of the calcium can be accomplished only by expensive acid leaching and liquid solid separation processes, the use of a gaseous trapping material offers significant economic advantages over the addition of solid non-regenerable trapping materials. The results of examples 1 through 6 are:

TABLE 4

Sulfur Forms in Reacted Coal

| | Sample | wt. % Ash | wt. % Sulfur | wt. % Sulfate | wt. % Pyrite | wt. % FeS | wt. % Tot S - HCl washed |
|---|---|---|---|---|---|---|---|
| 1 | Raw coal | 9.7 | 3.52 | 0.42 | 0.35 | 0.0 | 3.10 |
| 2 | HCl-treated | 8.8 | 3.10 | 0.01 | 0.35 | 0.0 | 3.10 |
| 3 | Raw coal - $C_2H_4$ treated | 11.9 | 2.99 | 0.01 | 0.93 | 0.26 | 2.72 |
| 4 | HCl-treated $C_2H_4$ treated | 10.5 | 2.44 | 0.01 | 0.09 | 0.0 | 2.43 |
| 5 | Raw coal $N_2$ treated | 12.2 | 3.26 | 0.01 | 0.50 | 0.0 | 3.25 |
| 6 | HCl-treated $N_2$ treated | 10.7 | 2.47 | 0.01 | 1.06 | 0.0 | 2.46 |

EXAMPLES 7-9

A W. Kentucky bituminous coal with the properties described in Table 5 was treated with gaseous nitrogen or ethylene and/or propylene for 15 min. at 390°-410° C. in a fixed bed reactor with 200 $cm^3$/min gas flow at 100 psi. The coal particles were −60+120 mesh.

TABLE 5

Properties of a W. Ky Coal

| Property | Ash | Total Sulfur | Sulfatic Sulfur | Pyritic Sulfur | Organic Sulfur |
|---|---|---|---|---|---|
| wt. % | 8.1 | 2.72 | 0.2 | 0.77 | 1.75 |

The following table illustrates the sulfur forms in the coal following the reaction:

TABLE 6

Ash Content and Sulfur Forms in Reacted Coal

| Example | Gas | wt. % Ash | % Total S | % Pyritic | % Sulfide | % Total S after HCl treatment |
|---|---|---|---|---|---|---|
| 7 | $N_2$ | 8.7 | 2.3 | 0.5 | 0.2 | 2.1 |
| 8 | $C_2H_4$ | 8.9 | 0.95 | 0.4 | 0.3 | 0.65 |
| 9 | $C_3H_6$ | 8.9 | 1.05 | 0.45 | 0.3 | 0.75 |

An analysis of the organic sulfur functional group distribution in the ROM coal showed that over ⅔ of the organic sulfur in this coal was thiolic or of the aliphatic sulfide structure. This is probably the reason why a large fraction of the organic sulfur was removed.

Having thus described my invention, I claim:

1. A process for removing sulfur from solid particles of coal, tar sand or bitumen comprising the steps of:

a. transferring solid particles of coal, tar sand or bitumen to a reactor and then conveying the solid particles of coal, tar sand or bitumen into the reactor;

b. conditioning the coal, tar sand, or bitumen prior to entry into the reactor by breaking and pulverizing the solid particles such that their sizes are reduced to three-eighths inch to zero prior to being conveyed into the reactor;

c. transferring into said reactor of the coal, tar sand or bitumen a fluid sulfur trapping material, selected from the group consisting essentially of ethylene, propylene, other olefins, aldehydes and ketones having similar properties of reversible reaction with $H_2S$;

d. conducting a reaction between the sulfur trapping material and the coal, tar sand or bitumen at a temperature of 370 to 430 degrees Centigrade for a period of one hour or less to produce sulfur compounds;

e. providing a pressure within the reactor of up to 1000 pounds per square inch;

f. moving the fluid sulfur trapping material through said reactor and through and around the solid particles of coal, tar sand or bitumen previously transferred into the reactor;

g. reacting said fluid sulfur trapping material with the resulting sulfur compound produced within said reactor from the solid particles of coal, tar sand or bitumen as the fluid trapping material is moved in and around the solid particles, and chemically binding the sulfur of said resulting sulfur compounds with said moving trapping material to form sulfurized trapping material;

h. separating the resulting sulfurized trapping material from the solid particles of coal, tar sand and bitumen and conveying the resulting sulfurized trapping material from said reactor; and i. regenerating the sulfur trapping material by decomposing it in a reactor and separating the resulting decomposition products to a sulfur compound, and a regenerated sulfur trapping material.

* * * * *